United States Patent [19]

Stoll

[11] Patent Number: 4,757,750

[45] Date of Patent: Jul. 19, 1988

[54] PISTON AND CYLINDER UNIT

[76] Inventor: Kurt Stoll, Lenzhalde 72, D-7300 Esslingen, Fed. Rep. of Germany

[21] Appl. No.: 927,597

[22] Filed: Oct. 31, 1986

[30] Foreign Application Priority Data

Dec. 13, 1985 [DE] Fed. Rep. of Germany ..... 3544107

[51] Int. Cl.[4] ..... F15B 15/14

[52] U.S. Cl. ..... 92/165 R; 92/165 PR

[58] Field of Search ..... 92/51, 165 R, 165 PR, 92/DIG. 1

[56] References Cited

U.S. PATENT DOCUMENTS 4,669,365 6/1987 Stoll ..... 92/165 R X

*Primary Examiner*—Gerald A. Michalsky

*Attorney, Agent, or Firm*—McGlew and Tuttle

[57] ABSTRACT

The invention relates to a piston and cylinder unit in which there are means for precluding twisting of the piston rod in relation to the cylinder. A part of the piston rod outside the cylinder is connected with a support member which surrounds a major part of the circumference of the cylinder in every position of the piston rod. On both sides of the median plane containing the longitudinal axis of the cylinder there are respective support section having sliding and support surfaces. These sliding and support surfaces face in opposite directions about the axis of the cylinder and each run on a flat runner surface, also extending in the length direction of the cylinder, on a base which is not able to turn or otherwise move in relation to the cylinder.

18 Claims, 3 Drawing Sheets

PISTON AND CYLINDER UNIT

BACKGROUND OF THE INVENTION

The invention relates to a piston and cylinder unit in the form of a hollow cylindrical member with a circular cross section, and whose ends are shut off by end caps. Inside the cylindrical member there is a piston with a circular cross section running axially so as to make sealing contact with the bore face of the cylindrical member. A piston rod is secured to the piston and extends from it out of the cylindrical member through one of the cylindrical member end caps so that the rod is able to be extended from said cylindrical member and retracted back into it. Furthermore there are means to prevent relative twisting between the piston rod and the cylindrical member.

In piston and cylinder units of this type the means for precluding relative rotation between the piston rod and the cylindrical member usually includes a complex arrangement with a rod fixed and parallel to the piston rod so as to extend through a hole in a part mounted on one of the end caps. Such means for preventing relative twisting are however very difficult to provide if the unit has to be made very compact in form as a consequence of the small amount of space available, since the anti-twist arrangement includes the part arranged perpendicularly to the direction of advance of the piston rod so that the arrangement is comparatively broad in construction. A further point is that the arrangement is not very robust so that when the piston rod is extended to a considerable degree and a substantial torsion force is acting on the piston rod, the degree of accuracy of the twist preventing means will leave to be desired, i. e. there will be an unacceptable degree of backlash. Accordingly, when an anti-twist system has to meet heavy loads the designer may have to rely on a piston or piston rod outline departing from the circular form. However such forms of piston and cylinder arrangements are disproportionally expensive owing to the complexity of manufacture and this serves to exclude them from economic application to many systems needing a twist-preventing means.

SHORT SUMMARY OF THE INVENTION

One object of the present invention is to devise a piston and cylinder unit of the type indicated which may be manufactured more simply.

A further aim of the invention is to devise such a unit which is cheaper to manufacture.

A further aim of the invention is to provide such an actuator unit which is highly accurate as regards the freedom from twist of the piston rod, i. e. freedom of twisting play between the piston and the cylindrical member in which it runs.

In accordance with a still further aim of the invention the twist preventing means is to be robust.

In order to achieve these or other objects appearing in the course of the present specification and claims, the part of the piston rod protruding from the cylindrical member is fixedly connected with a sliding support member which surrounds the cylindrical member circumferentially whatever the degree of extension of the piston rod. Furthermore on the two sides of a median or sagittal plane of the cylindrical member the support member member has symmetrically placed support sections with sliding and bearing surfaces which run on two plane bearing faces extending in the length direction of the cylindrical member. The plane bearing surfaces are on a base mounted in spatially fixed relationship with respect to said cylindrical member so that each of them are engaged by a respective one of said sliding and bearing surfaces on the support section at least during a part of the stroke of the piston.

The advantages of the piston and cylinder unit in keeping with the invention are on the one hand that owing to the continuous cooperation between the sliding and bearing surfaces on the support member and the sliding surfaces of the base one may be certain of completely backlash-free, i. e. extremely accurate, guiding action preventing any twist, even when the piston rod performs long strokes. There is a supporting action over a large surface acting in both the possible directions of turning about the cylindrical member axis and such action is able to fully counteract even large twisting forces acting on the piston rod. On the other hand the device in accordance with the invention may be manufactured with relatively small dimensions and there are no obstructive projecting parts. Furthermore, the arrangement in keeping with the invention may be simply and cheaply produced, since no changes have to be made to the cylindrical member itself in order to prevent the piston rod from twisting. This leads to the more specially convenient advantage that existing piston and cylinder arrangements not having any means for preventing twisting may be economically modified to be in accordance with the invention without having to utilize expensive parts.

Further advantageous developments of the invention are to be seen from the claims.

In accordance with one such further development the plane bearing surfaces on the base are coplanar with each other and in a plane which is tangential with respect to the outer face of the cylindrical member. This plane may alternatively be plane parallel to a plane which is tangential with respect to the outer face of the cylindrical member and is spaced from this plane. Moreover it is possible for the base to be a plate-like member fixedly joined to the cylindrical member so that one plate surface is turned to face the cylindrical member and having the bearing surfaces thereon. These further features of the invention make a particular contribution to an economic production of the sliding surfaces. It is more especially the design in which the base is plate-like which opens up wide possibilities as regards the application of piston and cylinder unit, since the cylindrical member together with the plate-like base may be very simply mounted at the desired position.

In keeping with a further development of the invention the support member secured to the piston rod, to prevent relative twist about the axis of the piston rod, has a cross section in the form of a segment of a hollow circular cylinder whose longitudinal axis to the longitudinal axis of the cylindrical member, the support member having two longitudinal edges forming the circumferential ends of the segment and also constituting the sliding bearing surfaces.

This makes it possible for the two support sections to have a relatively large distance between them so that they are able to withstand substantial stresses and guarantee accurate guiding and prevention of twist of the piston rod even when operating under heavy duty conditions. Furthermore the part cylindrical form of the support member is particularly economic to produce, and the overall arrangement will have an attractive appearance. Furthermore, the rounded-off design of the support member avoids the presence of interfering, laterally projecting parts so that when the piston and cylinder unit is made in a compact form there is a very considerably reduced risk of injury during operation of the unit.

In accordance with further developments of the invention at least a part of the inner face of the support member slides on an outer circumferential bearing face of the cylindrical member, as for example the outer surface of the cylindrical member itself. The support member may be in the form of a segment of a hollow circular cylinder which has a diameter substantially equal to the external diameter of the cylindrical member in the part thereof swept over by the support member. Furthermore the segment constituting the cross section of the support member extends for more than about half of the circumference of the cylindrical member.

These further features of the invention are characterized by a high degree of compactness, since the internal radial size of the support member means that it is practically complementary to the outer circumference of the cylindrical member. Since in this respect it then makes sliding contact over a large area of the external, peripheral surface of the cylindrical member, there is not only the effect of preventing twist of the piston rod but furthermore an improved guiding action in respect thereof. The feature involving an extent of the support member over more than about half the periphery of the cylindrical member means that high transverse forces may be resisted.

If the length of the support member as measured in the length direction of the cylindrical member is at least equal to the length of the piston rod, then the latter will be covered over and shielded for a large part of its length by the support member. If in addition the length of the base, as measured in the length direction of the cylindrical member, is equal to at least the length of the piston rod there is the further useful effect that the sliding and bearing faces of the support member cooperate with the sliding surfaces of the base for a large part of the length so that one may be sure of a precise guiding action as regards the support member.

The invention will now be described in more detail on the basis of specific working examples thereof as shown in the accompanying drawings.

LIST OF THE SEVERAL VIEWS OF THE DRAWINGS

Figure 1:
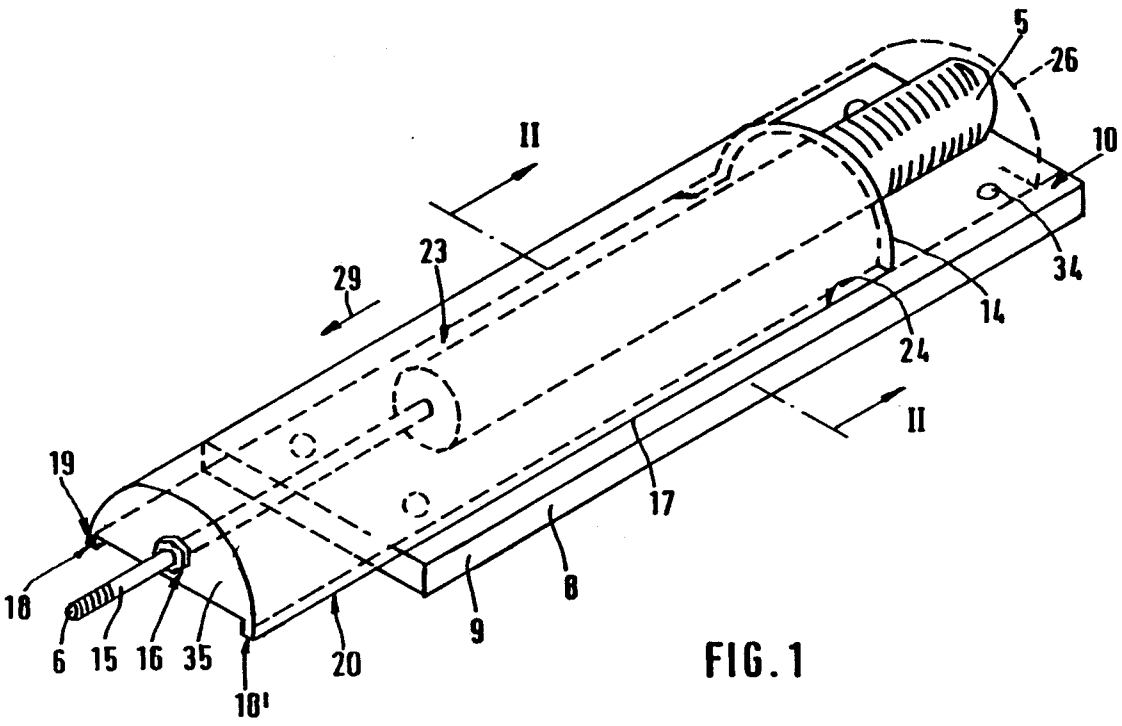
FIG. 1 shows a first embodiment of the piston and cylinder unit in accordance with the invention.
Figure 2A:
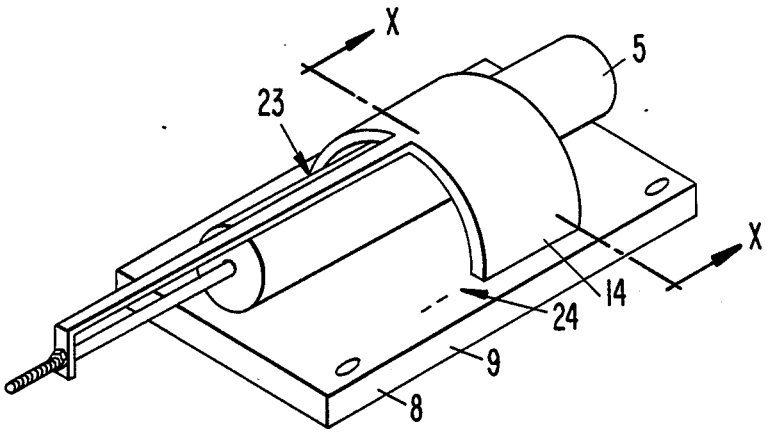
FIG. 2 is a cross section taken on the line II—II of FIG. 1.
Figure 2B:
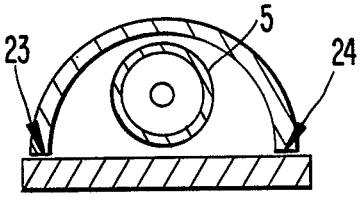

FIG. 2*a* is a perspective view similar to FIG. 1 of another embodiment of the invention;

FIG. 2*b* is a transverse section taken along the line X—X of FIG. 2*a*.

Figure 3:
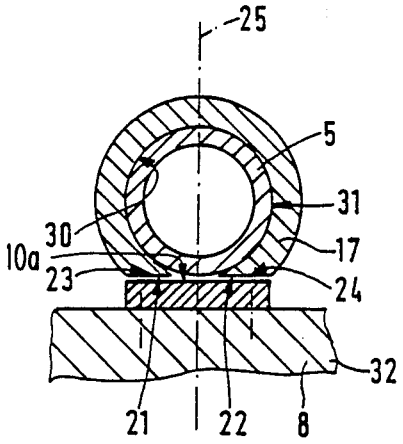

FIG. 3 is a cross section taken through a further embodiment of the piston and cylinder unit of the invention.

Figure 4:
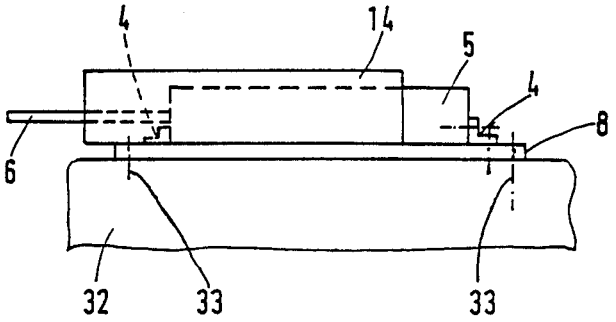

FIG. 4 is a side view of a further working example of the novel piston and cyinder unit.

DETAILED ACCOUNT OF EMBODIMENTS OF THE INVENTION

The piston and cylinder unit shown in FIG. 1 possesses a relatively slender, elongated cylindrical member 5 with the form of a circular hollow cylinder. Its two opposite ends are shut off by end caps which are not especially referenced. One of these cylinder end caps has a piston rod 6 running through it centrally with the provision of a seal therebetween. In the interior of the cylindrical member 5 the piston rod 6 is connected with a circular piston which is not shown and which sealingly engages the bore or inner face of the cylindrical member so as to divide it into two piston spaces. The latter may be supplied with fluid under pressure and evacuated so that the piston may be reciprocated and the piston rod 6 moved in and out of the cylindrical member.

Along its entire length, a part 7 of the outer face of the cylindrical member 5 is connected with a base 8 (see also FIG. 2) in relation to which it is fixed. This base 8 may be part of a machine or however, as in the present working example, a separate component which may be attached to part of a machine.

The cylindrical member 5 is in the present embodiment directly secured to the base 8, as for instance by a weldment or, as is shown in FIG. 4, by a screw connection involving the provision of lugs preferably arranged at the two ends of the cylindrical member 5 so that the same is screwed to the base 8.

In the present instance the base is constituted by a plate-like or tabular member 9, whose one planar surface 10 (FIGS. 1 and 2) is adjacent to the cylindrical member 5 so that the cylindrical member 5 in fact rests on its part 7. The length of the plate-like member 9, as measured in the length direction of the cylindrical member 5, is substantially equal to the length of the cylindrical member 5 or in the axial direction it may project somewhat beyond the ends of the cylindrical member 5. In the direction viewed the base 8 will be seen to have a generally rectangular plan outline.

The base 8, i. e. the plate-like member 9, is part of an arrangement for preventing twisting of the piston rod 6 in relation to the cylindrical member 6. This arrangement further includes a support member 14 which is fixedly secured at 16 to the section 15 of the piston rod which is outside of the cylindrical member 5 whatever the position of the piston rod 6. This connection between the support member 14 and the piston rod 6 is such that the support member 14 is not able to slide or to twist in relation to the piston rod 6. Accordingly the support member 14 moves with the piston rod 6 when the latter is extended from and retracted into the cylindrical member 5. Furthermore, the support member 14 is so made that it covers over a large part of the circumference of the cylindrical member 5 is every position of the piston rod 6.

Figure 2:
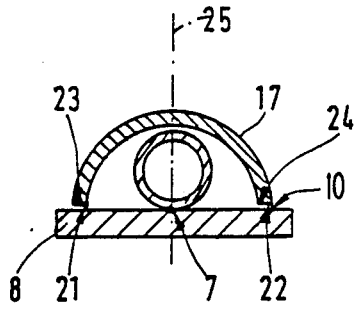

As will be seen from FIGS. 1 to 3, the support member 14 has the form of the segment of an elongated hollow cylinder 17 or cylindrical structure with an annular cross section (i. e. the cross section of the support member 14 is in the form of an annular segment), whose longitudinal axis is parallel to the longitudinal axis of the cylindrical member 5, and whose concave inner surface faces the cylindrical member 5 and the piston rod 6. The longitudinal terminating parts 18 and 18′ of the support member 14, to be seen on the right and the left in cross section, each constitute a supporting section 19 and 20 with sliding and bearing surfaces 21 and 22. The two surfaces 21 and 22 are directed in opposite directions about the circumference of the cylindrical member 14, and, dependent on the position of the piston rod 6, they have all their area or only a part thereof running on the sliding faces 23 and 24 of the plate-like member 9, i. e. of the base 8, so as to make a sliding engagement therewith or to have a sliding fit.

As will have been gathered, and as is more especially shown in FIGS. 2 and 3, the cylindrical member 5 is completely surrounded in the circumferential direction, part being covered by the support member 14 and part being covered by the base 8, the two sliding and bearing surfaces 21 and 22 being on the two sides of a median or sagittal plane 25 containing the longitudinal axis of the cylindrical member 5. In the working examples herein the plane 25 is at a right angle to the surface 10 of the base 8 so that in respect to the latter there is a symmetrical arrangement of the piston and cylinder unit, and the sliding and bearing surfaces 21 and 22 are respectively arranged at a longitudinal marginal part of the plate-like member 9.

The sliding and bearing surfaces 21 and 22 of the support member 14 therefore extend in the longitudinal direction of the member 14, and they run on the corresponding sliding surfaces 23 and 24 of the plate-like member 9 with a running fit. These sliding surfaces 23 and 24 are as well located to the sides of the said median plane 25 and are preferably in a common plane, i. e. they are preferably coplanar and on the rest of the surface 10 of the base 8. The sliding surfaces 23 and 24 are thus formed by parts of the surface of the base 8, something that greatly facilitates manufacture, since it is for example possible for the two sliding surfaces to be produced simply by a single face grinding operation on the surface 10 of the base 8. In this case the plane of the plate-like member, constituting the plate surface 10*a*, and the sliding surfaces 23 and 24 at the same time forms a plane that is tangential with respect to the circumference of the cylindrical member 5, as may be seen from FIGS. 1 to 3.

However, it is nevertheless to be understood that the cylindrical member 5 may also be arranged at some distance from the surface 10 of the plate-like base 8 and there is the further possibility of arranging a recess, generally complementary to a segment of the circumference of the cylindrical member 5, in the surface 10 so that the cylindrical member 5 is then seated in such recess. In such a case the plane containing the two sliding faces 23 and 24 would be a plane cutting the cylindrical member 5 as a secant.

It is an advantage if the length of the support member 14 as measured in the length direction of the cylindrical member 5 is at least equal to the length of the stroke of the piston 6 and in the retracted condition of the piston rod 6 cover the full length of the cylindrical member 5. In this retracted condition the sliding and bearing surfaces 21 and 22 are in full engagement with the associated sliding surfaces 23 and 24. This condition is marked in broken lines in FIG. 1. Accordingly, if the piston rod 6 is extended owing to the supply of fluid into one of the piston spaces in the interior of the cylindrical member 5, the supporting member 14 will move as indicated by the arrow 29 and as it progressively changes its position while performing a stroke, the part of the support member 14 attached to the piston rod part 15 will increasingly overlap the base 8, Such an intermediate condition is to be seen in FIG. 1 in which it is marked in thick, full lines; in this case the sliding and bearing surfaces 21 and 22 are only partly still on the sliding surfaces 23 and 24. This condition will also however apply in the fully extended state of the piston rod 6 so that in this case as well there will still be an effective cooperation between the surfaces of the support member and the plate-like base 8.

In the case of the piston and cylinder unit viewed in FIGS. 1 and 2 the support member 14 has the form of a longitudinally halved hollow cylinder, that is to say it is the result of dividing a hollow cylinder along its diametrical plane. The internal radius of this hollow cylinder is in this case selected to be slightly greater than the external diameter of the cylindrical member 5 so that the support member 14 spans the cylindrical member 5 in the form of an arch as seen in FIG. 2. The two sliding and bearing surfaces 21 and 22 are in a common tangential plane with respect to the cylindrical member 5 and are at a relatively large distance from the above-described median plane 25. Accordingly there is a large leverage so that the support member 14 is able to effectively resist a torsional load acting on the piston rod 6 by bearing on the surface 10 of the plate-like base 8 with the consequence that the piston rod is firmly held to prevent it from twisting even when it is considerably extended.

Unlike the working example shown in FIGS. 1 and 2 in the case of the embodiment of the invention to be seen in FIG. 3 the support member 14, which is in the form of a hollow cylinder open on one side, is designed so that its inner surface 30, or a part thereof, facing the cylindrical member 5, runs with a sliding fit on the outer face 31 of the latter. Although here this face is the outer face of the cylindrical member 5 itself, it may be on some other structure and consequently spaced from the circumference of the cylindrical member 5. It might for example be provided on radial projections with an annular form.

In the case of the working example of FIG. 3 the internal diameter of the support member 14 is accordingly generally equal to the external diameter of the cylindrical member 5 on the part thereof swept by the support member 14, i. e. the part thereof along which the support member moves. In addition the arcuate length of the hollow cylindrical support member subtends an angle in excess of 180° so that it contacts the cylindrical member 5 over more than half its circumference.

In addition to the efficient anti-twist effect, the working example of FIG. 3 is further such that the piston rod 6 is additionally guided by way of the support member 14, which has a part of its circumference encompassing the cylindrical member 5 so that the unit is in a better position to resist transverse forces. This is even so when the piston rod 6 has be extended to a relatively long projecting length.

The attachment of the support member 14 to the piston rod 6 is additionally due to the end of the support member 14 adjacent to the piston rod secton 15, having a cover plate 35 arranged thereon which has a through hole for the introduction of the piston rod 6 and is able to have the latter screwed into it. It would also be possible to produce the connection 16 by a suitable clamping means.

FIG. 4 shows a piston and cylinder unit in a condition fitted to a machine element 32, the base 8 being screwed to the element at 33. To make this form of attachment possible, the base 8 preferably has a number of through holes 34 (see FIG. 1) so that fitting screws may be introduced into them. FIG. 3 also shows the piston and cylinder unit screwed to the machine part 32 by screws extending through the base 8. The working example in accordance with FIG. 3, in which the support member 14 is arranged coaxially in relation to the cylindrical member 5, offers the additional useful effect that it is very narrow in a direction normal to the length direction of the cylindrical member 5 and only entails an insubstantial increase in the size of the cylindrical member. This is particularly due to the fact that the sliding and bearing surfaces 21 and 22 and the sliding surfaces 23 and 24 while admittedly being to the side of the median plane 25, partly extend under the part of the cylindrical member 5 adjacent to the base 8. The breadth of the plate-like member 9 is therefore limited generally to a size corresponding to the external diameter of the cylindrical member 5.

In the case of a further possible form of the invention, which is not illustrated, the support member is simply made in the form of a saddle with a relatively small length as measured in the axial direction of the cylindrical member 5 so that it is more in the nature of a single runner or arch spanning the cylindrical member 5.

As a further useful feature of the invention it is possible, in the case of the embodiments of FIGS. 1 to 4, for the length of the plate-like base 8 to be curtailed so as to have a length less than the length of the cylindrical member 5, if the support member 14 has such a length that there is contact between the sliding and bearing faces on the support member with the sliding faces on the base 8.

The anti-twist system in accordance with the present invention may with advantage also be used for the modification of already existing piston and cylinder units, which so far have not had any means preventing piston rod twist, since it is hardly necessary to modify the piston rod 6 in any way. Furthermore, the design of the support member 14 in the form of a hollow cylinder makes production at a low cost possible. A further advantage of the invention is that the piston and cylinder unit has a relatively short overall length.

I claim:

1. A piston and cylinder unit comprising:

a hollow cylindrical member with a circular cross section, end caps closing opposite ends of the cylindrical member, a piston with a circular cross section in the cylindrical member so as to be able to move axially therein while fluid-tightly engaging a bore surface of the cylindrical member, a piston rod secured to said piston and stretching from it out of the cylindrical member through one of the cylindrical member end caps, and being able to be extended from said cylindrical member and retracted back into it, a support member fixedly joined to a part of said piston rod which is outside of said cylindrical member, said support member being able to move in translation with the piston rod, said support member enveloping said cylindrical member in the circumferential direction thereof to a major extent whatever the degree of extension and retraction of said piston rod, said support member furthermore having two support sections placed symmetrically with respect to a median plane containing the longitudinal axis of the cylindrical member, each said support section being provided with a sliding bearing surface, a base mounted in spatially fixed relationship with respect to said cylindrical member, said base having two plane bearing faces running in the length direction of the cylindrical member and each being engaged by a respective one of said bearing surfaces on said support section at least during a part of the stroke of the piston.

2. The piston and cylinder unit as claimed in claim 1 wherein said plane bearing faces on said base are coplanar with each other.

3. The piston and cylinder unit as claimed in claim 2 wherein a plane containing the two bearing faces is a tangential plane with respect to an outer face of said cylindrical member.

4. The piston and cylinder unit as claimed in claim 2 wherein a plane containing the two bearing faces on the one hand is plane parallel to a plane tangential with respect to an outer face of said cylindrical member and on the other hand is spaced from said cylindrical member.

5. The piston and cylinder unit as claimed in claim 2 wherein said base is a plate-like member fixedly joined to said cylindrical member and having one plate face turned to face the cylindrical member and having the bearing faces thereon.

6. The piston and cylinder unit as claimed in claim 5 wherein the base has a rectangular outline, is adapted for attachment to a machine and has the outer face of the cylindrical member contacting it.

7. The piston and cylinder unit as claimed in claim 1 wherein the piston rod is moved through a given distance corresponding to the distance between its end positions thereof the support member is moved along a section of the length of the cylindrical member corresponding to the length of such given distance.

8. The piston and cylinder unit as claimed in claim 1 wherein said support member is secured to said piston rod to preclude relative twisting therebetween about the axis of the piston rod, and said support member has in cross section the form of a segment of a hollow circular cylinder whose longitudinal axis is parallel to the longitudinal axis of the cylindrical member, said member, said support member having two longitudinal edges forming the circumferential ends of said segment and also constituting the sliding bearing surface.

9. The piston and cylinder unit as claimed in claim 8 wherein said support member has an inner face of which at least a part slidingly engages an outer circumferential bearing face arranged about said cylindrical member.

10. The piston and cylinder unit as claimed in claim 9 wherein said support member in the form of a segment of a hollow circular cylinder has a diameter substantially equal to the external diameter of said cylindrical member in the part thereof swept over by said support member.

11. The piston and cylinder unit as claimed in claim 10 wherein said segment constituting the cross section of said support member extends more than about half the circumference of said cylindrical member.

12. The piston and cylinder unit as claimed in claim 8 wherein said support member has an inner face of which at least a part slidingly engages an outer circumferential bearing face formed on said cylindrical member.

13. The piston and cylinder unit as claimed in claim 8 wherein said support member has an internal diameter in excess of the external diameter of said cylindrical member in the part thereof swept by said support member.

14. The piston and cylinder unit as claimed in claim 8 wherein said support member has an internal radius in excess of the external diameter of the cylindrical member in the part thereof swept by said support member.

15. The piston and cylinder unit as claimed in claim 8 wherein said support member is arranged so as to be coaxially aligned with said cylindrical member.

16. The piston and cylinder unit as claimed in claim 8 wherein said support member is in the form of a saddle so as to constitute a runner seated on the cylindrical member.

17. The piston and cylinder unit as claimed in claim 1 wherein the length of the base as measured in the length direction of the cylindrical member is equal to at least the length of the stroke of the piston rod.

18. The piston and cylinder unit as claimed in claim 1 wherein the length of the support member, as measured in the length direction of the cylindrical member, is equal to at least the length of the piston rod.

* * * * *